US006883486B2

(12) United States Patent
Schweiger

(10) Patent No.: US 6,883,486 B2
(45) Date of Patent: Apr. 26, 2005

(54) CAST-IN-ANTI-ROTATION FEATURE FOR ENGINE COMPONENTS SUBJECT TO MOVEMENT

(75) Inventor: David J. Schweiger, Pewaukee, WI (US)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 10/647,712

(22) Filed: Aug. 25, 2003

(65) Prior Publication Data

US 2005/0045137 A1 Mar. 3, 2005

(51) Int. Cl.[7] ..... F02M 35/10
(52) U.S. Cl. ..... 123/184.21
(58) Field of Search ..... 123/184.21

(56) References Cited

U.S. PATENT DOCUMENTS 4,013,049 A 3/1977 Dilgard et al.
4,321,978 A 3/1982 Tominaga et al.
6,067,949 A 5/2000 Hughes et al.
6,286,471 B1 9/2001 Powell

*Primary Examiner*—Andrew M. Dolinar
*Assistant Examiner*—Katrina B. Harris
(74) *Attorney, Agent, or Firm*—Rader, Fishman & Grauer, PLLC

(57) ABSTRACT

A manifold anti-rotation system for engines includes a manifold having an end for interfacing with a manifold interface portion of an engine cylinder head, and a mounting collar. The manifold includes a protrusion extending from a periphery of the manifold end. The mounting collar comprises a collar body having a central aperture defined by an aperture wall wherein the aperture receives the manifold end therein. The mounting collar further includes a projection extending from a top surface thereof. The manifold protrusion and the collar projection are positioned to abut one another to prevent the manifold from rotating with respect to the mounting collar beyond the manifold protrusion.

19 Claims, 3 Drawing Sheets

CAST-IN-ANTI-ROTATION FEATURE FOR ENGINE COMPONENTS SUBJECT TO MOVEMENT

TECHNICAL FIELD

The present invention relates to engine components in general and in particular to anti-rotation systems for engine components to prevent undesired rotation.

BACKGROUND

Manifolds and manifold attachment components are well known in the combustion engine industry. Typically, a manifold has both an intake manifold for ducting air or a desired combustible fuel-air mixture to the engine cylinders and an exhaust manifold for ducting exhaust gasses from the combustion process away from the engine cylinders. At the interface with the engine, the manifold is typically tubular in shape and is aligned with an intake or exhaust port of the engine cylinder head. While the manifold may have attachment features fabricated into the manifold to affix it to the cylinder head, typically a retaining or mounting collar is used. The tubular end of the manifold is received by a like aperture in the collar, and by attaching the collar to the cylinder head, the manifold is aligned with the desired port in the cylinder head and gaseously sealed so that the combustible or exhaust gasses do not leak from the interface.

Depending on the engine and manifold design, the manner of retaining and gaseously sealing the manifold-cylinder head interface can vary from engine to engine. Because engines and vehicle components are usually fabricated and sub-assembled at different geographical sites, these components by necessity are transported from the fabrication and subassembly sites to a single final assembly site where the finished vehicle is assembled. The transported components must arrive at the final assembly point undamaged and ready for assembly. Thus, depending on the component, various measures, such as specific packing materials and temporary fixtures, must be employed to maintain the sub-assembled integrity of the component.

One such instance of a necessary protective measure involves the transport of motorcycle engines from the engine manufacturing site to the final assembly site. The intake manifold is affixed to the cylinder head with a mounting collar. The mounting collar employs a seal between the collar, the cylinder head, and the manifold to prevent the leakage of undesired gasses at the interface of the manifold with the cylinder head. With the tubular configuration of the manifold at the interface with the cylinder head and unsupported at an opposite end, the manifold is subject to unwanted rotation relative to the mounting collar. Such rotation may damage the seal, and thus a defect in the finished vehicle. Presently, special temporary brackets are utilized on the engine-manifold assembly to prevent rotation. The bracket must be removed prior to installation of the engine in the vehicle and thereby subjecting the manifold to unwanted rotation during the rigors of final assembly. The necessary installation and subsequent removal of the temporary bracket adds unwanted labor and material that is purely preventative in nature and does not add to the final vehicle functionality.

Therefore, there is a need in the industry for an anti-rotation system between vehicle components such as an anti-rotation system to prevent undesired rotation of engine components with respect to one another prior to final assembly without utilizing temporary fixtures or brackets.

SUMMARY OF THE INVENTION

One aspect of the present invention is directed to a manifold anti-rotation system for engines. The anti-rotation system includes a manifold having an end for interfacing with a manifold interface portion of an engine cylinder head. The manifold includes a protrusion extending outwardly from a periphery of the manifold end. A mounting collar is also included, having a collar body with a central aperture defined by an aperture wall wherein the aperture receives the manifold end therein. The mounting collar further includes a projection extending upwardly from a top surface thereof. The manifold protrusion and the collar projection are positioned to abut one another to prevent the manifold from rotating beyond the manifold protrusion in an undesired manner with respect to the mounting collar.

Another aspect of the present invention is directed to a mounting collar for mounting a manifold to a cylinder head of an engine. The collar assembly comprises a collar having a central aperture therethrough defined by an aperture wall for receiving an end of the intake manifold and also includes a projection extending upwardly from a top surface. A seal is retained by the collar and is for contacting the manifold and the intake portion of the cylinder head.

Yet another aspect of the present invention is directed to a manifold anti-rotation system for engines. The anti-rotation system includes a manifold having an end for interfacing with a portion of an engine cylinder head. The manifold includes a protrusion extending from a periphery of the manifold end. A mounting collar is employed where the mounting collar has a collar body and a seal retained by the collar body. The collar body includes a central aperture defined by an aperture wall, the aperture receiving the manifold end therein. The collar further includes a projection extending from a top surface thereof. The manifold protrusion and the collar projection are positioned to abut one another to prevent the manifold from rotating with respect to the mounting collar beyond the manifold protrusion. The seal contacts both the manifold and the intake portion of the cylinder head.

These and other advantages of the invention will be further understood and appreciated by those skilled in the art by reference to the following written specification, claims and appended drawings.

DETAILED DESCRIPTION OF THE PREFERRED EMBODIMENT

Figure 2:
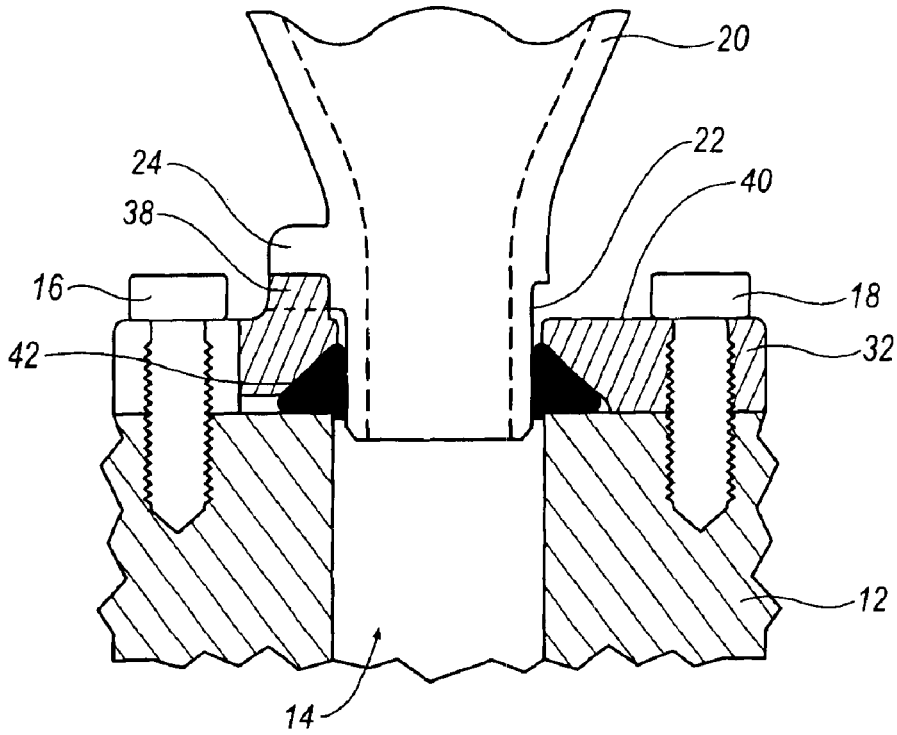
FIG. 2 is an elevational cross section of an assembled intake manifold and mounting collar of the present invention according to one embodiment of the invention.

For purposes of description herein, the terms "upper", "lower", "left", "rear", "right", "front", "vertical", "horizontal", and derivatives thereof shall relate to the invention as oriented in FIG. 2. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Turning to the drawings, FIG. 1-5 illustrate one embodiment of a manifold anti-rotation system 10 which, in the embodiment shown, functions to prevent an undesired rotation of a manifold with respect to a mounting collar. Those practiced in the art will readily recognize that the inventive concept of the present invention as embodied in system 10 is also applicable to other engine components and other manifold-mounting collar interfaces.

Figure 1:
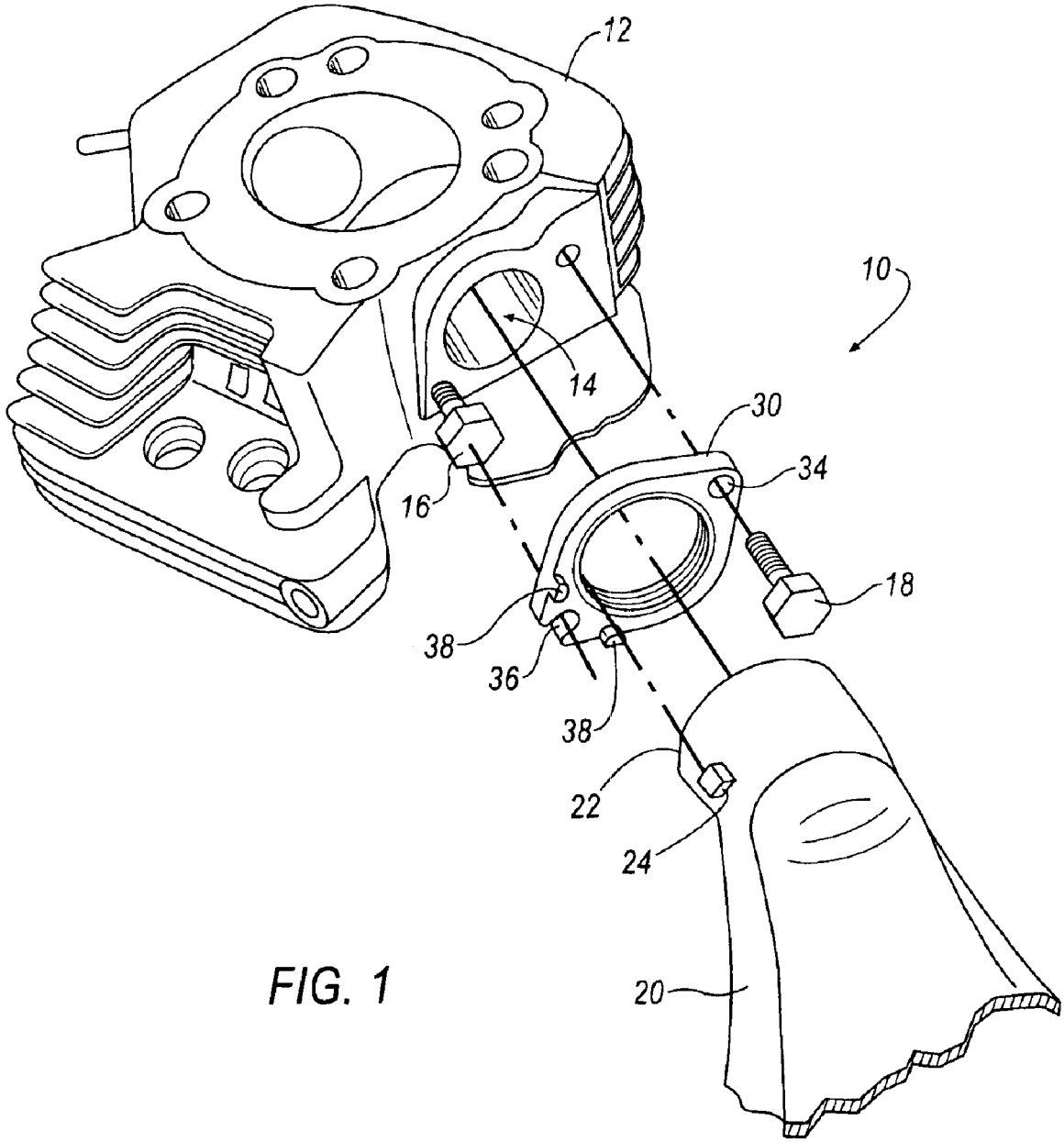
FIG. 1 is an exploded perspective view of an embodiment of the present invention showing the present invention aligning a manifold to a mounting collar and an engine cylinder head.

Manifold anti-rotation system 10, most easily seen in FIG. 1, includes a manifold 20 received in a mounting collar 30 to interface with an intake portion 14 of an engine cylinder head 12. Mounting collar 30 is affixed to intake portion 14 with fasteners 16 and 18 to thereby align and retain an end 22 of manifold 20 with the intake portion 14. Fasteners 16 and 18 are here shown as common bolts. In instances where engine components interfere with the installation of fasteners 16 and 18, one or more of fasteners 16 can be partially installed in cylinder head 12. With corresponding slots 36 in mounting collar 30, collar 30 can be laterally slid into position and thereby engage the one or more fasteners 16. Fasteners 16 can then be fully installed, such as by applying the proper torque to fastener 16 to securely clamp mounting collar 30 to cylinder head 12. In areas where access to install fastener 18 is not obstructed, a hole 34 is able to receive fastener 18 after alignment of mounting collar 30 to cylinder head 12. Those practiced in the art will recognize that while a two-fastener configuration with one slot 36 and one hole 34 in collar 30 is depicted in the present embodiment, configurations utilizing three, four or more fasteners are contemplated herein.

Manifold 20, as illustrated in FIG. 1, can be of any overall configuration depending on the positioning of the engine with respect to an inlet interface (not shown) between the manifold and, for example an air cleaner or carburetor (also not shown). Manifold 20 includes an end 22 for interfacing with the inlet portion 14 of cylinder head 12. Manifold end 22 is typically cylindrical in shape. A protrusion 24 extends from an outer peripheral face of manifold end 22. The positioning of protrusion 24 is discussed below.

Figure 3:
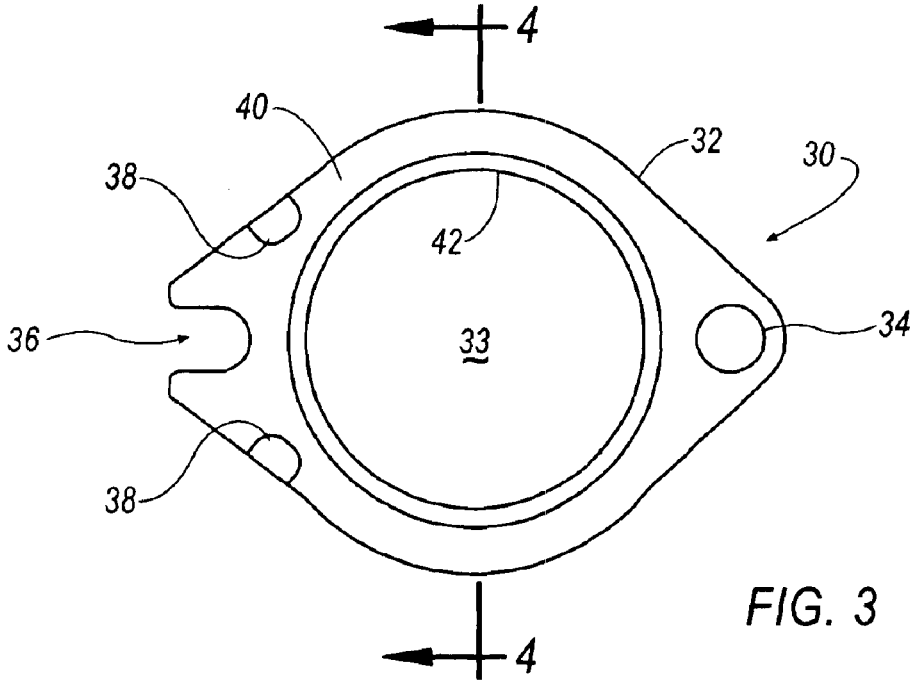
FIG. 3 is a plan view of an engine intake manifold mounting collar assembly according to an embodiment of the invention.
Figure 4:
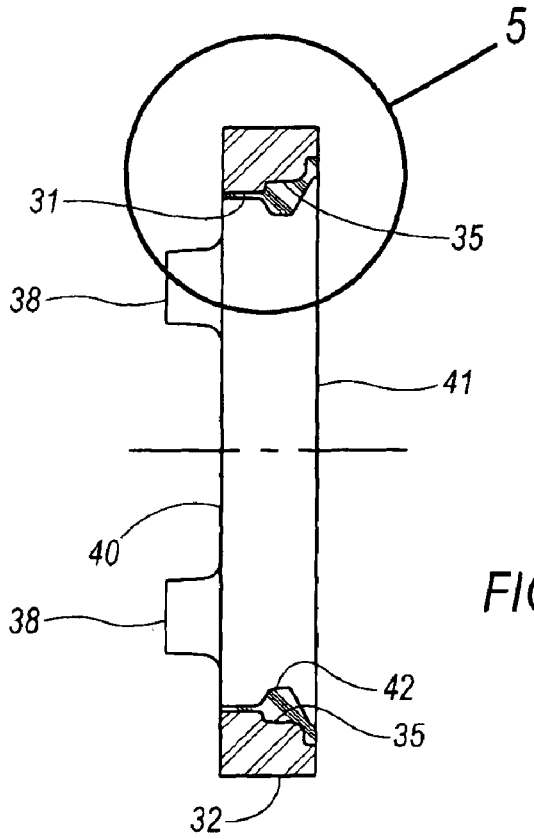
FIG. 4 is an elevation cross-section of a mounting collar assembly of FIG. 3 taken along the line 44.
Figure 5:
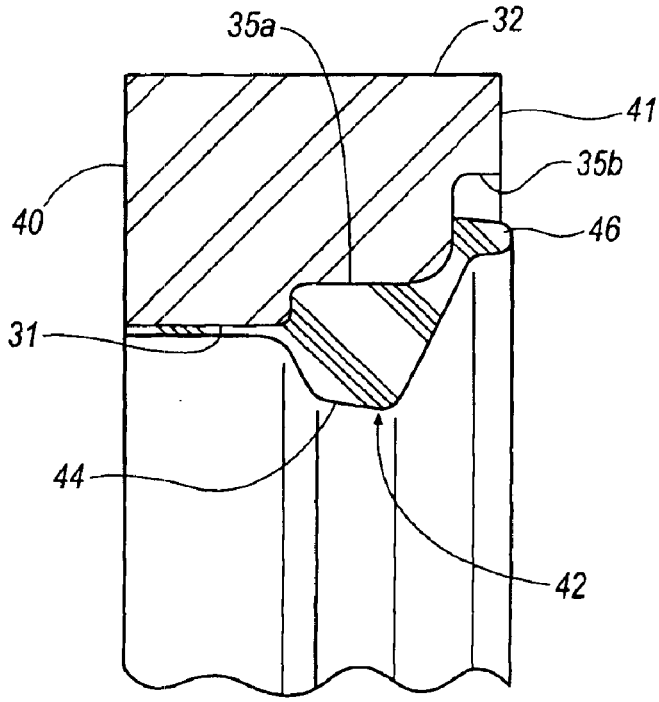
FIG. 5 is an enlarged view of a one of the cross-sectional portions of FIG. 4.

Mounting collar 30, as most clearly illustrated in FIGS. 3–5, includes a collar body 32. Collar body 32 is configured to define a central aperture 33 therethrough with aperture wall 31 and sized for receiving manifold end 22. A combination of holes 34 and slots 36 are formed in collar body 32 to match the mounting provisions of cylinder head 12 to receive fasteners 16 and 18 therethrough. While collar body 32 in its most common configuration is illustrated herein as having a diametrically opposed hole 34 and slot 36, multiple holes 34 or slots 36 can be used as a particular manifold 20 to cylinder head 12 configuration dictates.

In accordance with one aspect of the invention mounting collar 30 also includes at least one collar projection 38 extending upwardly from a top surface 40 of collar body 32. Collar projection 38 is positioned circumferentially about central aperture 33.

The positions of collar projection 38 and manifold protrusion 24 are such that upon assembly of manifold 20 with mounting collar 30, collar projection 38 and manifold protrusion 24 rotate in the same plane. Thereby, a vertical side of each projection 38 and protrusion 24 physically abut one another when a desired rotational limit is reached between manifold 20 and mounting collar 30. Mounting collar 30 can also include two collar projections 38 circumferentially spaced one from the other to provide a rotational limitation in both the clockwise and counterclockwise directions. In this case, manifold protrusion 24 is positioned between the two collar projections 38, and at each limit of rotation manifold protrusion 24 physically abuts one or the other of collar projections 38.

The circumferential spacing of collar projections 38 is typically less than 180 degrees with the manifold protrusion 24 positioned within the less than 180 degree spacing. Collar projections 38 can be circumferentially spaced such that in configurations of manifold to cylinder head which are mirror images, a first collar projection 38 corresponds to the desired rotational limitation of manifold 20 of one interface, and a second collar projection 38 corresponds to a mirror image interface thereby permitting the utilization of a single design of the mounting collar 30 for both interfaces. The positioning of the pair of projections 38 is here illustrated as being symmetrical about slot 36, however those practiced in the art will recognize that any circumferential positioning of a spaced pair of collar projections is possible and contemplated herein.

Mounting collar 30 can also have one or more pairs of collar projections 38 spaced about the circumference of central aperture 33, wherein the collar projections 38 of each pair are circumferentially spaced one from the other by slightly more than the width of manifold protrusion 24. This provides the ability to key manifold 20 in one or more unrotatable positions with respect to mounting collar 30 by positioning manifold protrusion between the closely spaced collar projections 38 of each pair.

Mounting collar 30 can also include a resilient seal 42 to provide a seal between manifold 20, intake portion 14 and mounting collar 30 to prevent undesired gasses from leaking through the manifold to cylinder head interface. Seal 42 is received in a groove 35 defined in the bottom face 41 of collar body 32. As illustrated by FIGS. 4–5, groove 35 can be of two portions, a first portion 35*a* of groove 35 receives a first segment 44 of seal 42 for compressive sealing between manifold end 22 and collar body 32. A second portion 35*b* of groove 35 receives a second segment 46 of seal 42 for compressive sealing between cylinder head 12 and collar body 32.

As seen in FIGS. 1–2, fastener 16 is partially installed in cylinder head 12 the head of which extends therefrom a distance greater than the thickness of collar body 32. Manifold end 22 is received in central aperture 33 of mounting collar 30 such that manifold protrusion 24 and collar projection 38 are in a desired abutting relationship. The joined manifold 20 and mounting collar are then positioned on cylinder head 12 by laterally translating the mounting collar so that fastener 16 is received in slot 36. Mounting collar 30 is then positioned to align hole 34 with cylinder head 12 for the installation of fastener 18. Fasteners 16 and 18 are fully engaged to clamp mounting collar 30 to cylinder head 12 and compress seal 42. Seal 42 upon compression by full engagement of fasteners 16 and 18 is deformed to provide a first non-leaking seal between manifold end 22 and collar body 32, and a second non-leaking seal between cylinder head 12 and collar body 32, thereby preventing the undesired leaking of gas through the interface between manifold 20 and cylinder head 12.

In the foregoing description those skilled in the art will readily appreciate that modifications may be made to the invention without departing from the concepts disclosed herein. Such modifications are to be considered as included in the following claims, unless these claims expressly state otherwise.

What is claimed is:

1. A manifold anti-rotation system for engines having an engine cylinder head with a manifold interface portion, said anti-rotation system comprising:

a manifold having an end for interfacing with a manifold interface portion of an engine cylinder head, said manifold end having a protrusion extending from a periphery thereof; and a mounting collar further comprising a collar body having a central aperture therethrough defined by an aperture wall, said aperture receiving said manifold end therein, said mounting collar further including a projection extending from a top surface opposite from the cylinder head, said manifold protrusion and said collar projection cooperating to prevent said manifold from rotating with respect to said mounting collar beyond said manifold protrusion.

2. A manifold anti-rotation system as recited in claim 1, wherein said mounting collar includes at least two collar projections extending from said collar top surface.

3. A manifold anti-rotation system as recited in claim 2, wherein said two collar projections are spaced one from the other about a circumference of said central aperture.

4. A manifold anti-rotation system as recited in claim 3, wherein said circumferential spacing is less than 180 degrees.

5. A manifold anti-rotation system as recited in claim 4, wherein said manifold protrusion is positioned within said less than 180 degrees circumferential spacing of said collar projections.

6. A manifold anti-rotation system as recited in claim 5 wherein said circumferential spacing is slightly greater than a width of said manifold protrusion.

7. A manifold anti-rotation system as recited in claim 3, wherein said collar body has a slot therein oriented outwardly from said collar body and a hole therethrough for receiving fasteners to affix said mounting collar to the cylinder head.

8. A manifold anti-rotation system as recited in claim 7, wherein one of each said collar projections are circumferentially positioned on opposite sides of said slot.

9. A manifold anti-rotation system as recited in claim 8, wherein said collar projections are circumferentially centered about said slot.

10. A manifold anti-rotation system as recited in claim 1, further comprising a seal in contact with said manifold and the manifold interface portion of the cylinder head, said seal being retained by said collar body.

11. A manifold anti-rotation system as recited in claim 10, wherein said collar body further defines a groove in a bottom surface of said collar, said groove extending about said circumference of said central aperture and receives at least a portion of said seal therein.

12. A manifold anti-rotation system as recited in claim 11, wherein said groove has a first portion defined in said aperture wall, and a second portion defined in said collar bottom surface.

13. A manifold anti-rotation system as recited in claim 12, wherein said seal includes a first seal segment received in said first groove portion, and a second seal segment received in said second groove portion.

14. A manifold anti-rotation system as recited in claim 13, wherein said first seal segment is compressingly engaged between said first groove portion and said manifold end.

15. A manifold anti-rotation system as recited in claim 14, wherein said second seal segment is retained in said second groove portion, said second seal segment extending partially below said bottom collar surface for compressingly abutting the cylinder head.

16. A mounting collar for mounting a manifold to a cylinder head of an engine, said mounting collar comprising:

a collar body having a central aperture therethrough defined by an aperture wall for receiving an end of a manifold, and defining at least one aperture therethrough for receiving a fastener, and further including at least one collar projection extending upwardly from a top surface for cooperating with a corresponding protrusion extending outwardly from a manifold mounted by said mounting collar; and a seal retained by said collar body, said seal for abutting the manifold and the cylinder head.

17. A mounting collar as recited in claim 16, wherein at least one of said fastener apertures is a slot oriented outwardly from said collar body for receiving a fastener to affix said mounting collar to the cylinder head.

18. A mounting collar as recited in claim 16, wherein said collar body further defines a groove in a bottom surface of said collar, said groove extending about said circumference of said central aperture and receiving at least a portion of said seal therein.

19. A manifold anti-rotation system for engines having an intake portion of a cylinder head, said anti-rotation system comprising:

an intake manifold having an end for interfacing with the intake portion of the engine cylinder head, said intake manifold end having a protrusion extending from a periphery thereof; and a mounting collar comprising a collar body and a seal, said collar body having a central aperture defined by an aperture wall, said central aperture receiving said manifold end therein and further including a projection extending from a top surface opposite from the cylinder head, said manifold protrusion and said mounting collar projection positioned to abut one to the other to prevent said intake manifold from rotating with respect to said mounting collar beyond said manifold protrusion, and further wherein said seal contacts said manifold and the intake portion of the cylinder head, said seal being retained by said collar body.

* * * * *